US012606992B2

(12) United States Patent
Kean

(10) Patent No.: US 12,606,992 B2
(45) Date of Patent: Apr. 21, 2026

(54) DETERMINATION OF AN EXCAVATOR SWING BOOM ANGLE BASED ON THE DIRECTION OF THE CENTRIPETAL ACCELERATION

(71) Applicant: LEICA GEOSYSTEMS TECHNOLOGY A/S, Odense SØ (DK)

(72) Inventor: Michael Goulet Kean, Odense SØ (DK)

(73) Assignee: LEICA GEOSYSTEMS TECHNOLOGY A/S, Odense Sø (DK)

( * ) Notice: Subject to any disclaimer, the term of this patent is extended or adjusted under 35 U.S.C. 154(b) by 216 days.

(21) Appl. No.: 18/212,567

(22) Filed: Jun. 21, 2023

(65) Prior Publication Data

US 2023/0417025 A1 Dec. 28, 2023

(30) Foreign Application Priority Data

Jun. 22, 2022 (EP) ..... 22180529

(51) Int. Cl.
*E02F 9/26* (2006.01)

(52) U.S. Cl.
CPC ..... *E02F 9/264* (2013.01)

(58) Field of Classification Search
CPC ..... E02F 9/264
See application file for complete search history.

(56) References Cited

U.S. PATENT DOCUMENTS 5,442,868 A 8/1995 Ahn
2010/0324822 A1 12/2010 Coatantiec et al.
2016/0138240 A1 5/2016 Ikegami et al.
2016/0237655 A1* 8/2016 Baba ..... E02F 9/2037
2017/0055112 A1* 2/2017 Westphal ..... H04W 4/02
2020/0200537 A1 6/2020 Ceisel et al.
2020/0348137 A1* 11/2020 Jain ..... G01C 21/20
2021/0172152 A1* 6/2021 Hara ..... E02F 9/2058
2021/0180296 A1* 6/2021 Jaegy ..... G01B 21/22
2021/0215483 A1* 7/2021 Krone ..... G01S 19/14
2022/0267999 A1* 8/2022 Hartvig Andersen .. E02F 3/435
(Continued)

FOREIGN PATENT DOCUMENTS

DK 180402 B1 4/2021

OTHER PUBLICATIONS

Extended European Search Report dated Dec. 16, 2022 as received in Application No. 22180529.4.

*Primary Examiner* — Hunter B Lonsberry
*Assistant Examiner* — Harrison Heflin
(74) *Attorney, Agent, or Firm* — Maschoff Brennan

(57) ABSTRACT

A system for determining a swing boom angle of an excavator. The excavator comprises a lower part, an upper part comprising a cabin, the upper part being arranged on the lower part and configured to be rotated relative to the lower part about a first rotation axis and a swing boom arranged on the upper part and configured to be rotated relative to the upper part about a second rotation axis that an actual swing boom position defines a swing boom angle. The system comprises a first inertial measurement unit (IMU) configured to be mounted on the swing boom and to generate first IMU data, wherein the first IMU comprises at least one acceleration sensor and a processing unit. The processing unit is configured to receive the first IMU data, determine a direction of a centripetal acceleration acting on the first IMU and determine the swing boom angle.

16 Claims, 3 Drawing Sheets

(56) References Cited

U.S. PATENT DOCUMENTS

| | | | | |
|---|---|---|---|---|
| 2023/0018606 | A1* | 1/2023 | Kalantar | G01B 21/22 |
| 2023/0359209 | A1* | 11/2023 | Shatters | G05D 1/0223 |
| 2023/0392355 | A1* | 12/2023 | Knuchel | G01C 21/16 |
| 2024/0102266 | A1* | 3/2024 | Ishihara | E02F 9/265 |

* cited by examiner

DETERMINATION OF AN EXCAVATOR SWING BOOM ANGLE BASED ON THE DIRECTION OF THE CENTRIPETAL ACCELERATION

FIELD OF THE DISCLOSURE

The present disclosure relates to a system for determining a swing boom angle of an excavator, wherein the excavator comprises a lower part, an upper part comprising a cabin, the upper part being arranged on the lower part and configured to be rotated relative to the lower part about a first rotation axis and a swing boom arranged on the upper part and configured to be rotated relative to the upper part about a second rotation axis that an actual swing boom position defines a swing boom angle.

BACKGROUND

Large scale excavators are earth moving machines that consist of a lower part that rests on the ground and supports tracks or wheels to move the excavator, a rotating upper part mounted to the lower part by means of a large bearing with a first vertical rotation axis and a dig structure that is composed of several components attached to each other by means of linkage pins with horizontal rotation axis that are parallel to each other.

Miniature excavators are also capable of swinging the dig structure relative to the rotating upper part. There is a pin with a second vertical rotation axis in between the dig structure and the rotating upper part. This type of construction is called a swing boom because the boom swings relative to the upper part resulting in a swing boom angle.

Any grade control system designed for a fixed boom excavator requires additional sensors or software in order to correctly track the motion (yaw rotation) of the boom relative to the upper part on a swing boom excavator as the system cannot use gravity to determine the position. Further, they are able to measure changes in position, but they require an initialization or calibration scheme to determine an absolute position and in order to periodically reject accumulated measurement errors.

A typical excavator grade control system utilizes IMUs (inertial measurement units) to measure the motion of the swing boom relative to the rotating upper part. Accelerometers identify the direction of gravity at rest, and during periods of motion gyroscopes are integrated to track the displacement of the linkage. Often the accelerometer and gyroscope signals are combined using some form of filtering. Many methods are possible and can be conceptually reduced to applying a low pass filter to the accelerometer and high pass filter to the gyroscopes. Over time the integration of the gyroscope measurement will drift due to uncorrected bias and sensor noise. Gravity cannot be used to stabilize the swing boom rotation as the rotational axis is aligned or nearly aligned with gravity.

DK180402B1 discloses a wire sensor to measure the length of the cylinder used to actuate a swing boom movement on mini excavators with swing boom functionality. The wire sensor is a self-retracting spool of wire that has an angular encoder mounted to measure rotation of the spool relative to the housing. In this installation, the housing is mounted onto the main upper part of the excavator. The wire is extended and affixed to the swing boom structure. There is a one-to-one correspondence between the measurement of the angular encoder and the swing boom angle with respect to the upper part.

There is a need to develop systems which determine accurately the swing boom angle of excavator without having a long-term drift of the IMU-based measurement. Further, systems are required which provide alternative approaches to track the swing boom angle and do not rely on a wire sensor.

OBJECT OF THE DISCLOSURE

It is therefore an object of the disclosure to provide an improved system for determining a swing boom angle of an excavator.

This object is achieved by realizing at least part of the features of the independent claims. Features which further develop the disclosure in an alternative or advantageous manner are described in the dependent patent claims.

SUMMARY

The disclosure relates to a system for determining a swing boom angle of an excavator, wherein the excavator comprises a lower part, an upper part comprising a cabin, the upper part being arranged on the lower part and configured to be rotated relative to the lower part about a first rotation axis and a swing boom arranged on the upper part and configured to be rotated relative to the upper part about a second rotation axis that an actual swing boom position defines a swing boom angle. The system comprises a first inertial measurement unit (IMU) configured to be mounted on the swing boom and to generate first IMU data, wherein the first IMU comprises at least one acceleration sensor (accelerometer) and a processing unit. The processing unit is configured to receive the first IMU data, determine a direction of a centripetal acceleration acting on the first IMU based on the received first IMU data when the upper part rotates about the first rotation axis relative to the lower part and determine the swing boom angle based on the direction of the centripetal acceleration.

To determine when the upper part rotates, the processing unit receives information regarding the rotational motion state (i.e. whether the upper part is currently rotating) and reads the first IMU data coupled with this rotational motion state information. Examples of how rotational motion state information can be provided are: Can-bus of the excavator, reading of the excavator's control data, reading of the angle encoder on the first rotation axis, GPS on the cabin, etc.

It is clear to the skilled person that the number and type of the at least one acceleration sensor (accelerometer) has to be selected depending on the respective measuring task, embodiment of the disclosure, etc., in order to ensure the feasibility and the required measuring accuracy (e.g. if a single axis accelerometer is not appropriate for the specific measuring task, the skilled person would use e.g. multiple single axis accelerometers or e.g. one tri-axial accelerometer). By way of example and in a non-restrictive manner, at least a pair of accelerometers may be necessary to define the direction of the centripetal acceleration in the plane defined by the directions of the two accelerometer sense elements.

The rotation of the swing boom can be determined/identified, for example, by using one gyroscope mounted on the upper part and a another gyroscope mounted on the swing boom. A non-zero angular velocity measured by the gyroscope mounted on the upper part indicates the swing/rotation movement of the upper part. A difference in measured angular velocity between the gyroscope mounted on the upper part and the gyroscope mounted on the swing boom indicates swing boom motion relative to the upper part.

Further examples of how rotational motion (rotation of the upper part) state information can be provided are:

a) on a hydraulic excavator, motion of the joysticks generates pilot pressure signals that shift the spools in the main control valve. Left/right motion of the left joystick typically commands swing/rotation motion of the excavator (upper part). So if a pressure sensor is placed on both of those hydraulic circuits, the pressure signals indicate whether the excavator (upper part) is swinging/rotating or not, b) angle encoders in the joystick that tell when the joystick is deflected, c) a CAN message sent by an electronic joystick that can be decoded to determine whether the operator was commanding the excavator (upper part) to swing/rotate, d) a measurement device which is directly put on the spools in the hydraulic system and measures displacement of the swing spool in its bore, e) a gyroscope on the rotating upper part directly sensing the rotation.

The first and the second rotation axis are vertical axis which are parallel to each other. The dig structure is composed of several components including the swing boom attached to each other by means of linkage pins with horizontal rotation axis that are parallel to each other but perpendicular to the first and the second rotation axis. The swing boom rotates about such a horizontal axis when it is being raised or lowered.

When an IMU is mounted on a moving component (e.g. the swing boom), it measures the accelerations applied to the sense element. These accelerations can be decomposed into a gravitational component, a linear component related to transport motion of the lower part and components related to rigid body motion of the excavator components relative to each other (including centripetal accelerations caused by the rotation of the upper part about the first rotation axis and the rotation of the swing boom about the second rotation axis).

In addition to the at least one accelerometer, the disclosed IMUs may be composed of further components. The IMUs can comprise further accelerometers, in particular two accelerometers. Furthermore, the IMUs can also comprise additionally to the at least one accelerometer at least one gyroscope. In this manner, the IMUs can comprise two accelerometers and one gyroscope. An IMU containing two accelerometers makes sense especially if both accelerometers are single-axis accelerometers. When using three-axis accelerometers, it is also possible to use an IMU with only one accelerometer.

In a further embodiment, the system further comprises a display unit configured to be arranged in the cabin, wherein the display unit is connected to the processing unit. The display unit is configured to provide a visualization of swing boom angle information to an operator based on the swing boom angle.

The visualization of the swing boom angle information can be realised in different ways. On the one hand, the specific value of the swing boom angle can be shown as a number on the display. On the other hand, it is also possible to display the swing boom angle by colour coding or on a colour scale. For example, a red colour can be displayed for a swing boom position left (negative angle values) of the middle position (zero degrees), which changes to a blue colour for a swing boom position right (positive angle values) of the middle position. The gradation of the individual angle values can be done by mixing different colours. Also the display via a bar, which increases in length as the value of the swing boom angle increases, is conceivable. It is also possible to display the swing boom angle via a scale on which a needle moves according to the movement of the swing boom (comparable to a compass) and thus displays the corresponding swing boom angle. Other embodiments for visualization of the swing boom angle information are also conceivable.

In a further embodiment, the first IMU determines an angular velocity of the rotation of the swing boom about the first rotation axis, the first IMU sends out a signal/information about the angular velocity of the rotation of the swing boom about the first rotation axis and the processing unit is configured to receive the signal/information about the angular velocity of the rotation of the swing boom about the first rotation axis and to determine if the swing boom is rotating at a minimum angular velocity, wherein above this minimum angular velocity a determination of the centripetal acceleration direction is possible.

In other words, this minimum threshold (minimum angular velocity) for the swing/rotation speed of the swing boom must be exceeded in order to provide sufficient observability for the centripetal acceleration direction to be usable. Further, the system can compensate for the long-term drift of the IMU measurement as long as the excavator operation includes sufficient swinging of the upper part relative to the lower part.

The value for the minimum threshold can be determined based on a sensitivity analysis. The threshold can be estimated if the desired accuracy, the distance of the sensor (first IMU) from the center of rotation (first rotation axis), and the sensor measurement noise values are given. In practice a threshold of 2-3 rpm achieves a reasonable performance.

Since the centripetal acceleration is always perpendicular to the respective rotation axis and points to this rotation axis (center of rotation), the centripetal acceleration angle changes with regard to the mounting position of the first IMU on the swing boom. For this reason, the determination of the swing boom angle by means of the disclosed system depends on the mounting position of the first IMU, but the position of the first IMU does not necessarily have to be known, as the position can be determined by means of a suitable calibration.

In a further embodiment, the system further comprises a second IMU, wherein the second IMU comprises at least one acceleration sensor, configured to be mounted on the upper part. With the second IMU, comprising an accelerometer, mounted on the upper part, the gravitational components of the measured accelerations can be removed when the IMUs are aligned and the upper part rotates.

In a further embodiment, the first IMU comprises a first gyroscope and the second IMU comprises a second gyroscope, wherein the first gyroscope is configured to provide data about the position of the swing boom as first position data and the second gyroscope is configured to provide data about the position of the upper part as second position data.

In a further embodiment, the processing unit is further configured to receive the first and second position data, combine the first and second position data with the first and the second IMU data and determine the swing boom angle based on the data combination.

In other words, the upper part rotation rate is subtracted from the measured swing boom rotation rate to isolate relative rotation rate for integration. This also enables the use of the gyroscopes to calculate centripetal acceleration if desired.

In a further embodiment, the combination of the first and second position data with the first and the second IMU data is carried out by a sensor fusion algorithm.

In a further embodiment, the sensor fusion algorithm is a complementary filter and/or a Kalman filter and/or an iterative root finding scheme (iterative root seeking algorithm) and/or any other suitable method for combining the swing boom angle measurements.

The disclosed measurement system could be combined with gyroscope (gyro) integration to track the rotation of the upper part and the swing boom. During periods when the rotating upper part is stationary or rotating at low speed, the angular velocity of the upper part and the swing boom could be compared and a relative angular velocity could be calculated in the swing boom direction (subtracting the rotation rate of the upper part from the measured swing boom rotation rate to isolate the relative rotation rate). This relative angular velocity can be integrated to track the change in the swing boom angle. Whenever the upper part rotates relative to the lower part, the disclosed determination of the centripetal acceleration direction can be combined with the integrated swing boom angle measurement (usage of the first and second gyroscopes) using a sensor fusion algorithm. This would combine the two measurements, combining the continuous tracking provided by gyroscope integration with the disclosed system of directly measuring the swing boom angle when the upper part is rotating relative to the lower part.

In a further embodiment, the swing boom further comprises an arm and a bucket being attached to the swing boom. The first IMU can be mounted on the swing boom, the arm or the bucket of the excavator. The position of the first IMU does not need to be known exactly, as it can be determined by calibration. If the first IMU is mounted on the arm or the bucket, the first IMU is located further from the second rotation axis and therefor will provide an observable measurement at a lower rotation/swing speed.

In a further embodiment, the first IMU data are transformed from a coordinate system associated with the first IMU into a coordinate system associated with the upper part prior to the determination of the swing boom angle by the processing unit.

In a further embodiment, the system further comprises a motion model configured to track a motion of the upper part, the lower part or the swing boom, determine a type of motion based on the tracked motion, determine a motion acceleration and a gravitational acceleration based on the tracked motion of upper part, lower part or swing boom and change an execution of the sensor fusion algorithm and/or the determination of the direction of the centripetal acceleration based on the determined type of motion.

The motion is tracked to consist of transient behaviors with many contributions (this could be vibration or Euler accelerations or disturbances due to digging, etc.) and in response to this tracking the parameters of the sensor fusion algorithm are changed to prevent the sensor fusion from entraining errors into the fused estimate for the swing boom angle. Further, cases can be identified where the centripetal acceleration cannot be identified and therefore greater reliance is placed on gyroscope integration techniques to track swing boom angle during these periods.

In a further embodiment, the centripetal acceleration of the tracked motion is calculated by subtracting the gravitational acceleration from the motion acceleration.

In a further embodiment, the motion is tracked as a rotation of the upper part relative to the lower part about the vertical first rotation axis and a rotation of the swing boom relative to the upper part about a horizontal third rotation axis, wherein the third rotation axis is perpendicular to the first rotation axis. Based on the tracked motion, a centripetal acceleration of the rotation motion of the swing boom about the third rotation axis is determined based on the position of the first IMU and a centripetal acceleration of the rotation motion of the upper part about the first rotation axis is calculated by subtracting the gravitational acceleration and the centripetal acceleration of the rotation motion of the swing boom about the third rotation axis from the motion acceleration of the upper part.

In other words, in a specific embodiment, the motion is determined to consist of cabin swing motion in addition to lift/lower motion of the swing boom and in response to this determination:

- estimating the expected centripetal acceleration due to the lift/lower motion based in part on the position of the first IMU on the swing boom and/or the gyroscope measurement from the first IMU,
- isolating the cabin swing centripetal acceleration by subtracting an estimated gravitational acceleration and the estimated centripetal acceleration due to the lift/lower motion from the measured acceleration.

The position of the first IMU on the swing boom is known, so the exact direction of the centripetal motion experienced due to lift or lower motion of the boom is also known. So if the exact direction of the centripetal motion and the gravity are subtracted from the measured acceleration the cabin swing centripetal acceleration can be isolated.

In a further embodiment, the motion is tracked as a rotation of the upper part relative to the lower part about the first rotation axis and a rotation of the swing boom relative to the upper part about the second rotation axis. Based on the tracked motion, a centripetal acceleration of the rotation motion of the swing boom about the second rotation axis is determined based on the position of the first IMU and a centripetal acceleration of the rotation motion of the upper part about the first rotation axis is calculated by subtracting the gravitational acceleration and the determined centripetal acceleration of the rotation motion of the swing boom about the second rotation axis from the motion acceleration of the upper part.

In other words, in a specific embodiment, the motion is determined to consist of cabin swing motion in addition to boom swing motion relative to the cabin and in response to this determination

- estimating the expected centripetal acceleration due to the swing boom motion based in part on the position of the first IMU on the swing boom and/or the gyroscope measurement from the first IMU,
- isolating the cabin swing centripetal acceleration by subtracting an estimated gravitational acceleration and the estimated centripetal acceleration due to swing boom motion from the measured acceleration.

Because the position of the first IMU on the swing boom is known, the direction of that centripetal component in IMU coordinates is also known. The gyroscopes and position of the first IMU on the swing boom can be used to calculate the centripetal acceleration due to swing boom motion, and then isolate the cabin swing centripetal acceleration.

In a further embodiment, the system is configured to self-calibrate based on a self-calibration procedure including the steps:

- providing the swing boom in a first defined position, wherein the first defined position corresponds to a known first calibration swing boom angle, rotating the upper part about the first rotation axis relative to the lower part, determination of a calibration direction of the centripetal acceleration acting on the first IMU based on the received first IMU data when the upper part rotates, generation of calibration data regarding relationship between the directions of the centripetal acceleration and the swing boom angles based on the determined calibration direction of the centripetal acceleration and the known first calibration swing boom angle.

In a further embodiment, the self-calibration procedure in particular further includes the steps:

providing the swing boom in a second defined position, wherein the second defined position corresponds to a known second calibration swing boom angle, rotating the upper part about the first rotation axis relative to the lower part, and determination of a calibration direction of the centripetal acceleration acting on the first IMU based on the received first IMU data when the upper part rotates, generation of calibration data regarding relationship between the directions of the centripetal acceleration and the swing boom angles based on the determined calibration direction of the centripetal acceleration and the known first and/or second calibration swing boom angle.

BRIEF DESCRIPTION OF THE DRAWINGS

The disclosure is illustrated in more detail below, purely by way of example, with reference to working examples shown schematically in the drawing. Identical elements are labelled with the same reference numerals in the figures. The described embodiments are generally not shown true to scale and they are also not to be interpreted as limiting.

DETAILED DESCRIPTION

Figure 1:
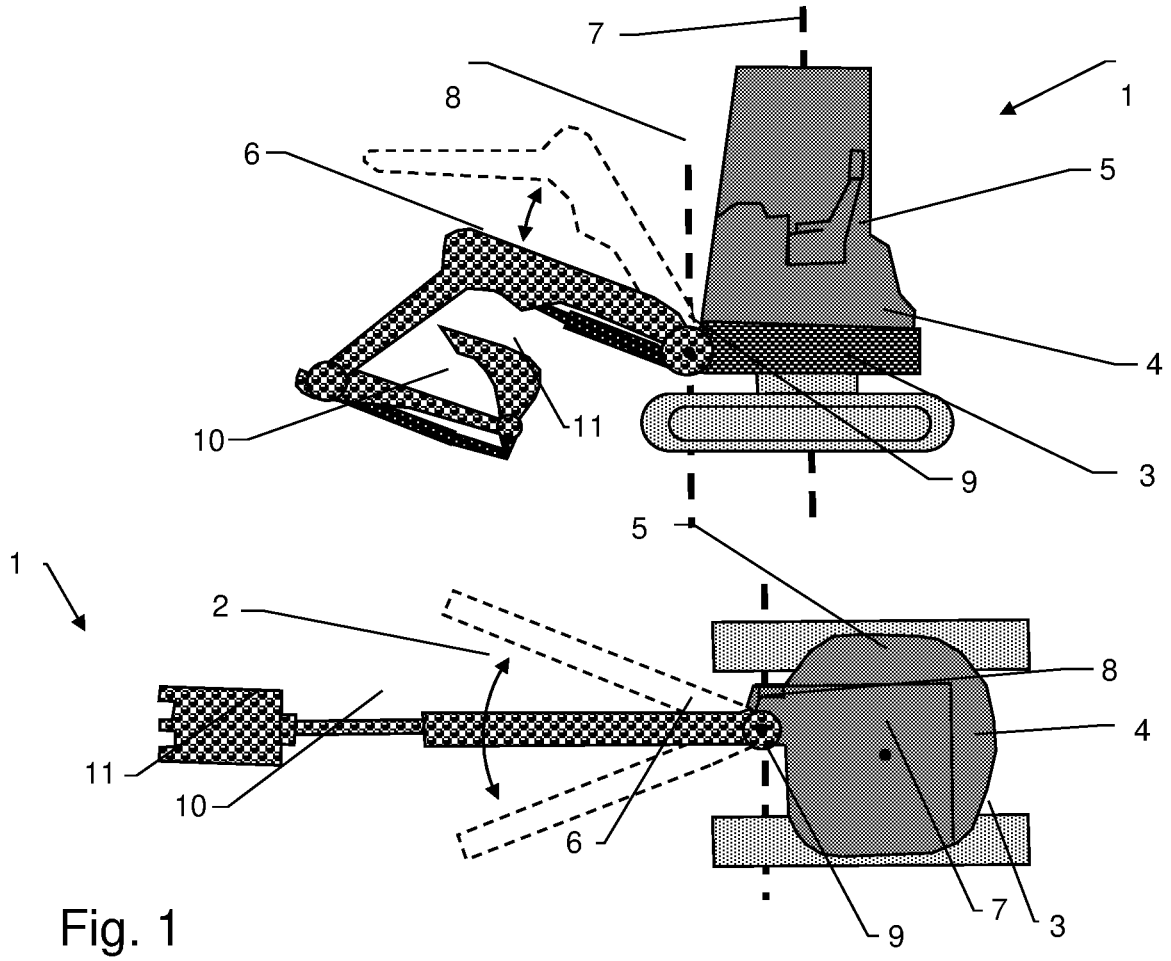
FIG. 1 shows a schematic illustration of a swing boom mini excavator in side view and from above.

FIG. 1 shows a schematic illustration of the (swing boom mini) excavator 1 in side view and from above to illustrate the swing boom angle 2. The excavator 1 comprises a lower part 3, an upper part 4 with a cabin 5 and a swing boom 6. The upper part 4 is arranged on the lower part 3 and configured to be rotated relative to the lower part 3 about the vertical first rotation axis 7. The swing boom 6 is arranged on the upper part 4 and configured to be rotated relative to the upper part 4 about the vertical second rotation axis 8 (this degree of freedom determines the swing boom angle 2), wherein the first and the second rotation axis 7, 8 are parallel. It is also possible to rotate the swing boom 6 about the horizontal third rotation axis 9 to raise or lower the swing boom 6 (this degree of freedom determines the so called boom angle). In the example shown an arm 10 and a bucket 11 are attached to the swing boom 6 which can also be moved via horizontal rotation axis. These horizontal rotation axes are parallel to the third rotation axis 9. The rotation/swinging movement of the swing boom 6 around the second rotation axis 8 results in different positions of the swing boom 6. The swing boom angle 2 is formed between the current position of the swing boom 6 and the upper part 4.

Figure 2:
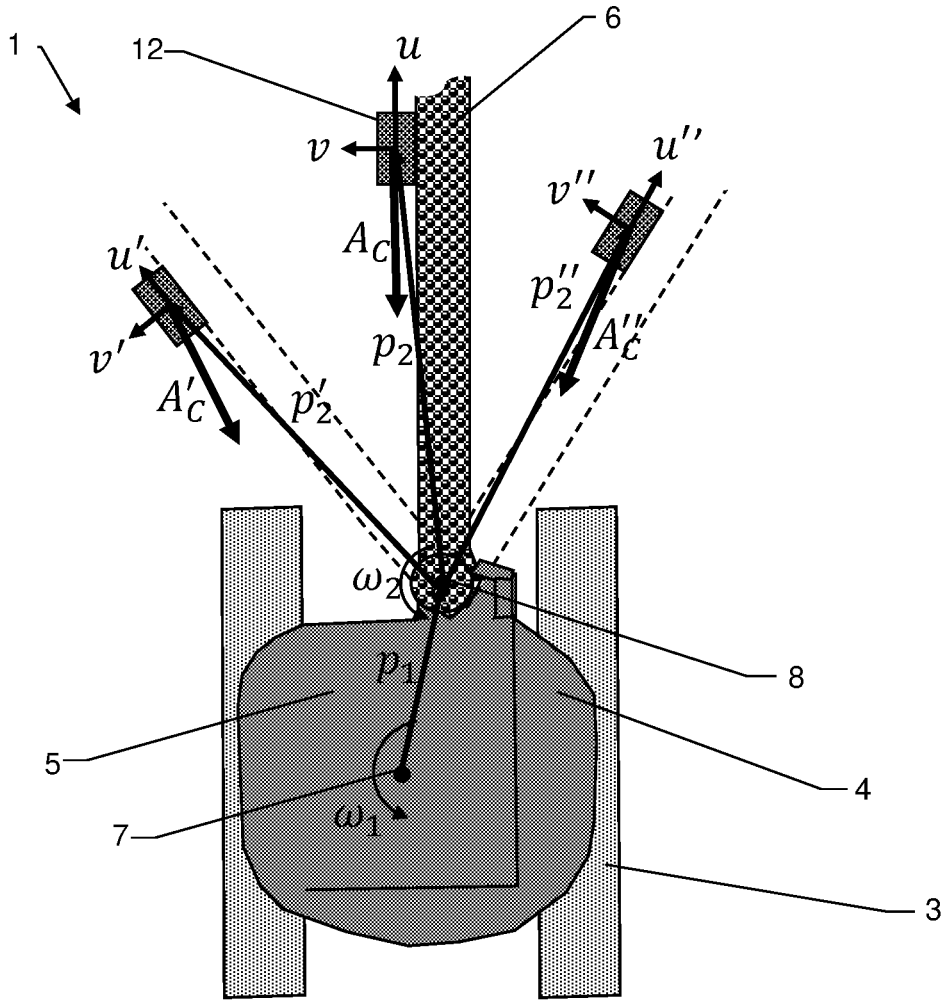
FIG. 2 shows a schematic illustration of the excavator from above to illustrate the different accelerations acting on the first IMU.

FIG. 2 shows a schematic illustration of the excavator 1 from above to illustrate the different accelerations acting on the first IMU 12 during the movement of the swing boom 6. When the swing boom 6 rotates, regardless of whether the rotation results from the swing boom 6 rotating about the second rotation axis 8 or whether the upper part 4 rotates about the first rotation axis 7 and thus rotates the swing boom 6 as well, the first IMU 12 mounted on the swing boom 6 will sense Euler accelerations, induced by changes in angular velocity, and centripetal accelerations, induced by constant angular velocity. At a fixed rotational speed, the centripetal acceleration $A_C$ that will be measured by the first IMU 12 can be written in terms of the angular velocity $\omega$ (angular velocity of the swing boom rotation: $\omega_2$; angular velocity of the upper part rotation: $\omega_1$) and the distance from the respective center of rotation $\rho$ (distance from the first to second rotation axis: $\rho_1$; distance from the second rotation axis to the first IMU: $\rho_2$; distance from the second rotation axis to the first IMU at a first changed position: $p_2'$; distance from the second rotation axis to the first IMU at a second changed position: $p_2''$).

$$A_C=\omega\times\omega\times\rho$$

The centripetal force $F_Z$ resulting from the centripetal acceleration $A_{centripetal}$ always points from the measurement position towards the center of rotation. This means that if the centripetal force $F_Z$ induced by the rotation of the upper part about the first rotation axis 7 can be isolated, the direction of the centripetal force $F_Z$ in the first IMU measurement frame will indicate the direction of the first rotation axis 7. The measurement direction will always be perpendicular to the first rotation axis 7. This means that the direction can be used to measure the orientation of the second rotation axis 8 relative to the first IMU measurement frame as well as the vector pointing from the origin of the first IMU measurement frame to the first rotation axis 7.

By assuming that the orientation of the first IMU 12 is being tracked relative to gravity, then the gravitational component of the acceleration R*g can be removed from the sensed motion acceleration $A_{Sensed}$ by assuming the measurement error is negligible. In this way, the dynamic component $A_{Dynamic}$ of the centripetal acceleration $A_C$ can be isolated.

$$A_{Dynamic}=A_{Sensed}-R*g$$

During steady state swinging motions (rotation of the swing boom 6 around the second rotation axis 8) in the absence of other actuations, this dynamic acceleration $A_{Dynamic}$ is entirely due to swing motion.

$$A_{Dynamic}=\omega_2\times\omega_2\times\rho_2$$

Since $A_{Dynamic}$ is always perpendicular to the second rotation axis 8 and points towards the second rotation axis 8 and we know that the Y axis of the swing boom 6 is always parallel to the XY plane for the rotating upper part 4, and thus perpendicular to the second rotation axis 8, a cross product can be used to determine the vector of the second rotation axis $v_2$.

$$v_2=-A_{Dynamic}\times\begin{bmatrix}0\\1\\0\end{bmatrix}$$

This measurement can then be nondimensionalized and the rotation between the first IMU measurement frame and the upper part frame using the X ($u_2(x)$) and Z ($u_2(z)$)

components of the direction of the second rotation axis $u_2$ in the first IMU measurement frame can be calculated.

$$u_2 = \frac{v_2}{\|v_2\|}$$

$$\theta_{SB} = a\tan2(-u_2(x), u_2(z))$$

The swing boom angle $\theta_{SB}$ can be confirmed and compared to the relative orientation calculated from the orientation of the first IMU 12 and the second IMU with respect to gravity.

Figure 3:
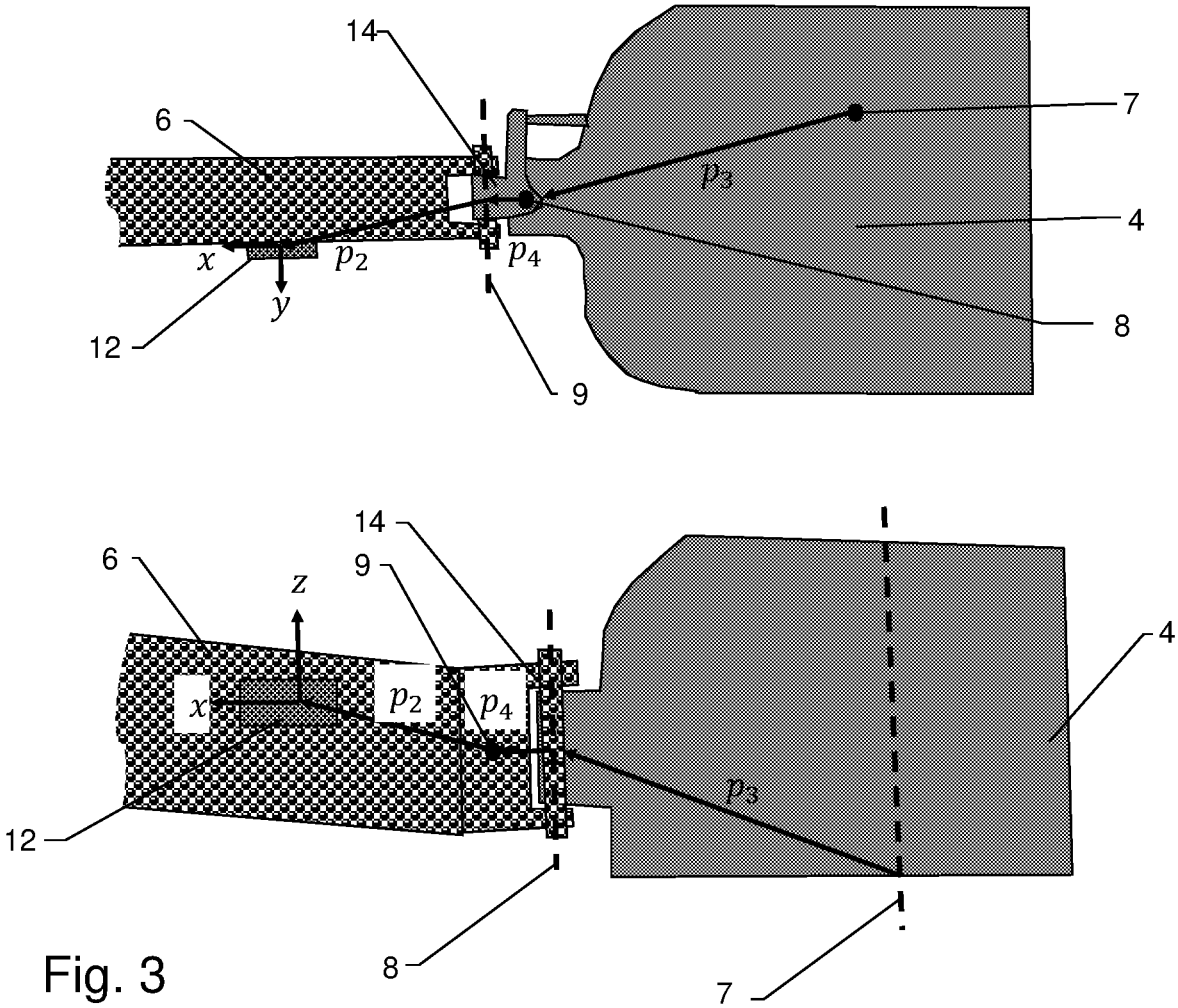
FIG. 3 shows a schematic illustration of the joint which arrange the swing boom on the upper part.

FIG. 3 shows a schematic illustration of the joint 14 which arrange the swing boom 6 on the upper part 4 to clarify the position of the first IMU 12 relative to the second and the third rotation axis 8, 9. There are two types of joints on mini excavator linkages. One type of joints enables the swing boom 6 to rotate about a horizontal axis (raise or lower movement of the swing boom 6) and the other type of joints enables the swing boom 6 to rotate about a vertical rotation axis (swing movement of the swing boom 6). The characteristic of the joint 14 that attaches the swing boom 6 to the upper part 4 is that this joint 14 allows the rotation of the swing boom 6 around a horizontal as well as a vertical rotation axis.

There is a second possibility which can be used to calculate the swing boom angle $\theta_{SB}$. The distance from the first IMU 12 to the second rotation axis 8 in the rotating upper part horizontal plane can be directly measured or the dynamic component $A_{Dynamic}$ of the centripetal acceleration $A_C$ from the first IMU measurement frame can be converted into the rotating upper part coordinate frame and the direction in the horizontal plane along with the estimated boom elevation angle can be used to estimate the swing boom angle $\theta_{SB}$.

The distance from the second rotation axis to the first IMU $\rho_2$ (dependent on the position of the first IMU on the swing boom) can be expressed in the coordinates of the rotating upper frame and can be written as:

$$\rho_2=\rho_3+R_4(\rho_4+R_5\rho_5)$$

It is known that the vertical components of $\rho_3$ (distance between the first rotation axis 7 and the horizontal third rotation axis 9) and $\rho_4$ (distance between the second 8 and the third rotation axis 9) are irrelevant as they lie along the first rotation axis direction, and thus do not contribute to the dynamic component $A_{Dynamic}$ of the centripetal acceleration $A_C$. The mounting position of the first IMU 12 with respect to the second rotation axis 8 can also be measured as $\rho_2$ and expressed in the first IMU measurement frame. With this information the X and Y components of $\rho_5$ (distance between the first IMU and the rotation center) can be calculated and expressed in body coordinates using rotation matrices.

Now the geometry can be related to the measured X and Y distances, noting that:

$$\rho_5(x) = \frac{-A_{Dynamic}(x)}{\omega_2^2}$$

$$\rho_5(y) = -\frac{A_{Dynamic}(y)}{\omega_2^2}$$

For instance, assuming the second rotation axis 8 is located 1 m forward and 50 mm to the left of the first rotation axis 7, that the third rotation axis 9 is 100 mm forward and 100 mm above the second rotation axis 8, and that the first IMU 12 is mounted 1 m along its X-axis, 150 mm along its Y-axis, and 250 mm along its Z-axis from the third rotation axis 9 on the side of the swing boom 6, the resulting distances from the second rotation axis 9 to the first IMU 12 in the XY plane of the upper part can be determined. A range of motion of the swing boom rotation about the third rotation axis 9 from −30 to 60 degrees and a range of motion of the swing boom rotation about the second rotation axis 8 of +/−45-degree can be assumed.

Regardless of which possibility is used, the swing boom angle 2 can be estimated by isolating the centripetal acceleration $A_C$ experienced by the first IMU 12, calculating the direction of the vector to the second rotation axis 8, the location of the second rotation axis 8, or both, and then cross referencing that with the angle of the swing boom rotation about the third rotation axis 9.

Although aspects are illustrated above, partly with reference to some preferred embodiments, it must be understood that numerous modifications and combinations of different features of the embodiments can be made. All of these modifications lie within the scope of the appended claims.

The invention claimed is:

1. A system for determining a swing boom angle of an excavator, wherein the excavator comprises:

a lower part, an upper part comprising a cabin, the upper part being arranged on the lower part and configured to be rotated relative to the lower part about a first rotation axis, a swing boom arranged on the upper part and configured to be rotated relative to the upper part about a second rotation axis that an actual swing boom position defines a swing boom angle, wherein the system comprises:

a first inertial measurement unit (IMU) configured to be mounted on the swing boom and to generate first IMU data, wherein the first IMU comprises at least one acceleration sensor, and a processing unit configured to:

receive the first IMU data, determine a direction of a centripetal acceleration acting on the first IMU based on the received first IMU data when the upper part rotates about the first rotation axis relative to the lower part, and determine the swing boom angle based on the direction of the centripetal acceleration, wherein the system further comprises a motion model configured to:

track a motion of the upper part, the lower part or the swing boom, determine a type of motion based on the tracked motion, determine a motion acceleration and a gravitational acceleration based on the tracked motion of upper part, lower part or swing boom, change an execution of the sensor fusion algorithm and/or the determination of the direction of the centripetal acceleration based on the determined type of motion, wherein the motion is tracked as:

a rotation of the upper part relative to the lower part about the first rotation axis, and a rotation of the swing boom relative to the upper part about a third rotation axis, wherein the third rotation axis is perpendicular to the first rotation axis, wherein based on the tracked motion:

a centripetal acceleration of the rotation motion of the swing boom about the third rotation axis is determined based on the position of the first IMU, a centripetal acceleration of the rotation motion of the upper part about the first rotation axis is calculated by subtracting the gravitational acceleration and the centripetal acceleration of the rotation motion of the swing boom about the third rotation axis from the motion acceleration of the upper part.

2. The system according to claim 1, wherein the system further comprises a display unit configured to be arranged in the cabin, wherein the display unit is connected to the processing unit, the display unit being configured to provide a visualization of swing boom angle information to an operator based on the swing boom angle.

3. The system according to claim 1, wherein the first IMU determines an angular velocity of the rotation of the swing boom about the first rotation axis, the first IMU sends out information about the angular velocity of the rotation of the swing boom about the first rotation axis, the processing unit is configured to receive the information about the angular velocity of the rotation of the swing boom about the first rotation axis and to determine if the swing boom is rotating at a minimum angular velocity, wherein above this minimum angular velocity a determination of the centripetal acceleration direction is possible.

4. The system according to claim 1, the system further comprising a second IMU, wherein the second IMU comprises at least one acceleration sensor, configured to be mounted on the upper part.

5. The system according to claim 4, with the first IMU comprising a first gyroscope and the second IMU comprising a second gyroscope, wherein the first gyroscope is configured to provide data about the position of the swing boom as first position data and the second gyroscope is configured to provide data about the position of the upper part as second position data.

6. The system according to claim 5, wherein the processing unit is further configured to:

receive the first and second position data, combine the first and second position data with the first and the second IMU data, determine the swing boom angle based on the data combination.

7. The system according to claim 6, wherein the combination of the first and second position data with the first and the second IMU data is carried out by a sensor fusion algorithm.

8. The system according to claim 7, wherein the sensor fusion algorithm is:

a complementary filter, and/or a Kalman filter, and/or an iterative root finding scheme.

9. The system according to claim 6, wherein the first IMU data are transformed from a coordinate system associated with the first IMU into a coordinate system associated with the upper part prior to the determination of the swing boom angle by the processing unit.

10. The system according to claim 1, wherein the swing boom further comprises an arm and a bucket being attached to the swing boom.

11. The system according to claim 10, wherein the first IMU data are transformed from a coordinate system associated with the first IMU into a coordinate system associated with the upper part prior to the determination of the swing boom angle by the processing unit.

12. The system according to claim 1, wherein the centripetal acceleration of the tracked motion is calculated by subtracting the gravitational acceleration from the motion acceleration.

13. The system according to claim 1, wherein the system is configured to self-calibrate based on a self-calibration procedure including the steps:

providing the swing boom in a first defined position, wherein the first defined position corresponds to a known first calibration swing boom angle, rotating the upper part about the first rotation axis relative to the lower part, determination of a calibration direction of the centripetal acceleration acting on the first IMU based on the received first IMU data when the upper part rotates, generation of calibration data regarding relationship between the directions of the centripetal acceleration and the swing boom angles based on the determined calibration direction of the centripetal acceleration and the known first calibration swing boom angle.

14. A system for determining a swing boom angle of an excavator, wherein the excavator comprises:

a lower part, an upper part comprising a cabin, the upper part being arranged on the lower part and configured to be rotated relative to the lower part about a first rotation axis, a swing boom arranged on the upper part and configured to be rotated relative to the upper part about a second rotation axis that an actual swing boom position defines a swing boom angle, wherein the system comprises:

a first inertial measurement unit (IMU) configured to be mounted on the swing boom and to generate first IMU data, wherein the first IMU comprises at least one acceleration sensor, and a processing unit configured to:

receive the first IMU data, determine a direction of a centripetal acceleration acting on the first IMU based on the received first IMU data when the upper part rotates about the first rotation axis relative to the lower part, and determine the swing boom angle based on the direction of the centripetal acceleration, wherein the system further comprises a motion model configured to:

track a motion of the upper part, the lower part or the swing boom, determine a type of motion based on the tracked motion, determine a motion acceleration and a gravitational acceleration based on the tracked motion of upper part, lower part or swing boom, change an execution of the sensor fusion algorithm and/or the determination of the direction of the centripetal acceleration based on the determined type of motion, wherein the centripetal acceleration of the tracked motion is calculated by subtracting the gravitational acceleration from the motion acceleration, wherein the motion is tracked as a rotation of the upper part relative to the lower part about the first rotation axis, and a rotation of the swing boom relative to the upper part about a third rotation axis, wherein the third rotation axis is perpendicular to the first rotation axis, wherein based on the tracked motion:

a centripetal acceleration of the rotation motion of the swing boom about the third rotation axis is determined based on the position of the first IMU, a centripetal acceleration of the rotation motion of the upper part about the first rotation axis is calculated by subtracting the gravitational acceleration and the centripetal acceleration of the rotation motion of the swing boom about the third rotation axis from the motion acceleration of the upper part.

15. A system for determining a swing boom angle of an excavator, wherein the excavator comprises:

a lower part, an upper part comprising a cabin, the upper part being arranged on the lower part and configured to be rotated relative to the lower part about a first rotation axis, a swing boom arranged on the upper part and configured to be rotated relative to the upper part about a second rotation axis that an actual swing boom position defines a swing boom angle, wherein the system comprises:

a first inertial measurement unit (IMU) configured to be mounted on the swing boom and to generate first IMU data, wherein the first IMU comprises at least one acceleration sensor, and a processing unit configured to:

receive the first IMU data, determine a direction of a centripetal acceleration acting on the first IMU based on the received first IMU data when the upper part rotates about the first rotation axis relative to the lower part, and determine the swing boom angle based on the direction of the centripetal acceleration, wherein the system further comprises a motion model configured to:

track a motion of the upper part, the lower part or the swing boom, determine a type of motion based on the tracked motion, determine a motion acceleration and a gravitational acceleration based on the tracked motion of upper part, lower part or swing boom, change an execution of the sensor fusion algorithm and/or the determination of the direction of the centripetal acceleration based on the determined type of motion, wherein the motion is tracked as a rotation of the upper part relative to the lower part about the first rotation axis, and a rotation of the swing boom relative to the upper part about the second rotation axis, wherein based on the tracked motion:

a centripetal acceleration of the rotation motion of the swing boom about the second rotation axis is determined based on the position of the first IMU, a centripetal acceleration of the rotation motion of the upper part about the first rotation axis is calculated by subtracting the gravitational acceleration and the determined centripetal acceleration of the rotation motion of the swing boom about the second rotation axis from the motion acceleration of the upper part.

16. A system for determining a swing boom angle of an excavator, wherein the excavator comprises:

a lower part, an upper part comprising a cabin, the upper part being arranged on the lower part and configured to be rotated relative to the lower part about a first rotation axis, a swing boom arranged on the upper part and configured to be rotated relative to the upper part about a second rotation axis that an actual swing boom position defines a swing boom angle, wherein the system comprises:

a first inertial measurement unit (IMU) configured to be mounted on the swing boom and to generate first IMU data, wherein the first IMU comprises at least one acceleration sensor, and a processing unit configured to:

receive the first IMU data, determine a direction of a centripetal acceleration acting on the first IMU based on the received first IMU data when the upper part rotates about the first rotation axis relative to the lower part, and determine the swing boom angle based on the direction of the centripetal acceleration, wherein the system further comprises a motion model configured to:

track a motion of the upper part, the lower part or the swing boom, determine a type of motion based on the tracked motion, determine a motion acceleration and a gravitational acceleration based on the tracked motion of upper part, lower part or swing boom, change an execution of the sensor fusion algorithm and/or the determination of the direction of the centripetal acceleration based on the determined type of motion, wherein the centripetal acceleration of the tracked motion is calculated by subtracting the gravitational acceleration from the motion acceleration, wherein the motion is tracked as a rotation of the upper part relative to the lower part about the first rotation axis, and a rotation of the swing boom relative to the upper part about the second rotation axis, wherein based on the tracked motion:

a centripetal acceleration of the rotation motion of the swing boom about the second rotation axis is determined based on the position of the first IMU, a centripetal acceleration of the rotation motion of the upper part about the first rotation axis is calculated by subtracting the gravitational acceleration and the determined centripetal acceleration of the rotation motion of the swing boom about the second rotation axis from the motion acceleration of the upper part.

* * * * *